US009517911B2

(12) United States Patent
Xia

(10) Patent No.: US 9,517,911 B2
(45) Date of Patent: Dec. 13, 2016

(54) PAPER CURRENCY RECEIVING DEVICE AND HOT WHEEL FLOATING CONTROL DEVICE THEREOF

(71) Applicant: GRG Banking Equipment Co., Ltd., Guangzhou, Guangdong (CN)

(72) Inventor: Zhigao Xia, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/781,266

(22) PCT Filed: Apr. 25, 2014

(86) PCT No.: PCT/CN2014/076205
§ 371 (c)(1),
(2) Date: Sep. 29, 2015

(87) PCT Pub. No.: WO2015/003519
PCT Pub. Date: Jan. 15, 2015

(65) Prior Publication Data

US 2016/0052742 A1 Feb. 25, 2016

(30) Foreign Application Priority Data

Jul. 11, 2013 (CN) ..... 2013 1 0292039

(51) Int. Cl.
*B65H 29/40* (2006.01)
*G07D 11/00* (2006.01)
(Continued)

(52) U.S. Cl.
CPC ..... *B65H 29/40* (2013.01); *B65H 31/10* (2013.01); *B65H 43/08* (2013.01);
(Continued)

(58) Field of Classification Search
CPC ..... B65H 29/20; B65H 29/38; B65H 29/40; B65H 29/54; B65H 31/04; B65H 31/08; B65H 31/10; B65H 31/36; B65H 43/06; B65H 43/08; B65H 2301/16; B65H 2307/421; B65H 2301/42264; B65H 2402/52; B65H 2402/521; B65H 2402/5211; B65H 2402/522; B65H 2402/5221; B65H 2404/117; B65H 2404/1341; B65H 2404/1526; B65H 2404/17; B65H 2404/65; B65H 2404/656; B65H 2404/661; B65H 2511/152; B65H 2553/51; B65H 2601/271; B65H 2402/24; B65H 2402/30; B65H 2402/31; B65H 2404/1523; B65H 2701/1912
(Continued)

(56) References Cited

U.S. PATENT DOCUMENTS 4,120,491 A * 10/1978 Lang ..... B65H 29/40 271/178
4,552,351 A * 11/1985 Tsukamoto ..... G07D 11/0003 271/160
(Continued)

FOREIGN PATENT DOCUMENTS

CN 101145255 A 3/2008
CN 201845375 U 5/2011
(Continued)

OTHER PUBLICATIONS

Written Opinion of the International Searching Authority, dated Aug. 5, 2014, from corresponding International Application No. PCT/CN2014/076205.
(Continued)

*Primary Examiner* — Ernesto Suarez

(57) ABSTRACT

A banknote receiving device includes a supporting frame; a pair of roller wheels, located at an inlet of the banknote
(Continued)

receiving device and configured to bring in banknotes by clamping; a blade wheel, mounted on the supporting frame via a rotating shaft, the blade wheel being joined with the pair of roller wheels and configured to convey the banknotes delivered from the pair of roller wheels in a way of carrying the banknotes and rotating at a high speed; and a support plate, located below the blade wheel, configured to carry the banknotes delivered from the blade wheel. The banknote receiving device further includes a blade wheel floating control device configured to control an upward and downward floating of the blade wheel and to further control the support plate to move downward according to an upward floating degree of the blade wheel to increase the banknote receiving space.

9 Claims, 5 Drawing Sheets

(51) Int. Cl.
*B65H 31/10* (2006.01)
*B65H 43/08* (2006.01)

(52) U.S. Cl.
CPC ..... *G07D 11/0018* (2013.01); *G07D 11/0021* (2013.01); *B65H 2301/42264* (2013.01); *B65H 2402/5221* (2013.01); *B65H 2404/152* (2013.01); *B65H 2404/1526* (2013.01); *B65H 2511/20* (2013.01); *B65H 2553/51* (2013.01); *B65H 2601/271* (2013.01); *B65H 2701/1912* (2013.01)

(58) Field of Classification Search
USPC ..... 271/215, 217, 187, 81, 273, 274
See application file for complete search history.

(56) References Cited

U.S. PATENT DOCUMENTS

| | | | | | |
|---|---|---|---|---|---|
| 4,718,655 | A | * | 1/1988 | Okayama | B65H 3/06 271/111 |
| 5,201,504 | A | * | 4/1993 | Fallos | B43M 3/045 271/178 |
| 5,409,201 | A | * | 4/1995 | Kramer | B42C 1/12 270/58.13 |
| 5,518,230 | A | * | 5/1996 | Scarlata | B65H 29/40 271/155 |
| 5,899,448 | A | * | 5/1999 | Hosking | B65H 1/025 271/110 |

FOREIGN PATENT DOCUMENTS

| | | | |
|---|---|---|---|
| CN | 103136853 | A | 6/2013 |
| CN | 103325175 | A | 9/2013 |
| JP | 2000185860 | A | 7/2000 |
| JP | 2010052884 | A | 3/2013 |
| JP | 2013058072 | A | 3/2013 |

OTHER PUBLICATIONS

International search report, dated Aug. 5, 2014, from corresponding International Application No. PCT/CN2014/076205.

* cited by examiner

PAPER CURRENCY RECEIVING DEVICE AND HOT WHEEL FLOATING CONTROL DEVICE THEREOF

This application is the national phase of International Application No. PCT/CN2014/076205, titled "PAPER CURRENCY RECEIVING DEVICE AND HOT WHEEL FLOATING CONTROL DEVICE THEREOF", filed on Apr. 25, 2014, which claims the benefit of priority to Chinese Patent Application No. 201310292039.0 titled "BANKNOTE RECEIVING DEVICE AND BLADE WHEEL FLOATING CONTROL DEVICE THEREOF", filed with the Chinese State Intellectual Property Office on Jul. 11, 2013, each of which applications is incorporated herein by reference to the maximum extent allowable by law.

TECHNICAL FIELD

The present application relates to financial equipment, especially to a device using a blade wheel to stack banknotes, and particularly to a banknote receiving device having a blade wheel structure.

BACKGROUND

A banknote stacking device usually employs a blade wheel structure, in this structure, the blade wheel usually is rotatable around a fixed support shaft, and the rolled banknotes are stacked on a banknote support plate. If the banknote support plate is fixed, the number of the banknotes stacked by the device is limited, that is because, the space cannot be large due to the requirement of implementing an orderly stacking, otherwise, the banknotes will be stacked in disorder. If the banknote support plate is flexibly movable, the number of stacked banknotes may be increased, however the banknote stacking space provided by the flexible structure is still limited. Therefore, it is very necessary to provide a banknote receiving device with a blade wheel structure which has a large banknote stacking space.

SUMMARY

For solving the problem that the banknote receiving device with a blade wheel structure has a limited banknote stacking space, a banknote receiving device is provided according to the present application, which can not only stack banknotes orderly, but also maximize the banknote receiving space.

A blade wheel floating control device is further provided according to the present application.

The banknote receiving device includes a supporting frame, configured to mount subsequent components; a pair of roller wheels, located at an inlet of the banknote receiving device and configured to bring in banknotes by clamping; a blade wheel, mounted on the supporting frame via a rotating shaft, the blade wheel being joined with the pair of roller wheels and configured to convey the banknotes delivered from the pair of roller wheels in a way of carrying the banknotes and rotating at a high speed; and a support plate, located below the blade wheel, configured to carry the banknotes delivered from the blade wheel, the support plate being movable up and down under the action of a transmission mechanism to adjust a size of a banknote receiving space. The banknote receiving device further includes a blade wheel floating control device configured to control an upward and downward floating of the blade wheel and to further control the support plate to move downward according to an upward floating degree of the blade wheel to increase the banknote receiving space.

Preferably, the supporting frame includes two lateral plates having the same structure, each of the lateral plates is provided with a waist-shaped hole, and two ends of the rotating shaft are respectively mounted in the waist-shaped holes of the two lateral plates via respective bearings.

Specifically, the blade wheel floating control device includes a coded disc, which is fixed on the rotating shaft, is rotatable synchronously with the blade wheel and floatable up and down with the blade wheel; a sensor, fixed above the coded disc; and a pair of tension springs arranged symmetrically. The coded disc is configured to optionally block a light-transmittable point of the sensor when the coded disc floats up and down with the blade wheel, to allow the sensor to sense the upward floating degree of the blade wheel. Each of the tension springs has an upper end fixed on the respective bearing of the rotating shaft and a lower end fixed on the respective lateral plate of the supporting frame.

Preferably, each of the bearings includes an inner bearing and an outer bearing, the inner bearing is sleeved on the rotating shaft and arranged in the respective waist-shaped hole of the supporting frame, the outer bearing is sleeved on the inner bearing and assembled on the rotating shaft, and is not assembled in the waist-shaped hole of the supporting frame, and the outer bearing is fixed to a small supporting piece, and the small supporting piece is provided with a small hole for hanging the tension spring.

Preferably, an initial position of the coded disc is located at a position 0.7 mm below the light-transmittable point of the sensor.

Preferably, a diameter of a circular arc of the waist-shaped hole is 12 mm, and a distance between the centers of circle at two ends of the waist-shaped hole is 3 mm.

The banknote receiving device further includes a controller configured to receive a signal of the sensor being blocked and control the support plate to move downward by a predetermined distance.

The blade wheel floating control device includes a supporting frame, having two lateral plates having the same structure, each of the lateral plates being provided with a waist-shaped hole; a rotating shaft, two ends of which are respectively mounted in the waist-shaped holes of the two lateral plates of the supporting frame, wherein the rotating shaft is floatable up and down in the waist-shaped holes, and the blade wheel is mounted on the rotating shaft and is rotatable around the rotating shaft at a high speed; a coded disc, which is fixed on the rotating shaft, is rotatable synchronously with the blade wheel and floatable up and down with the rotating shaft; a sensor, fixed above the coded disc, wherein the coded disc is configured to optionally block a light-transmittable point of the sensor when the coded disc floats up and down with the rotating shaft, to allow the sensor to sense an upward floating degree of the blade wheel; and a pair of tension springs arranged symmetrically, each of the tension springs having an upper end fixed on a respective bearing of the rotating shaft and a lower end fixed on the respective lateral plate of the supporting frame.

Preferably, an initial position of the coded disc is located at a position 0.7 mm below the light-transmittable point of the sensor.

Preferably, a diameter of a circular arc of the waist-shaped hole is slightly greater than an outer diameter of an inner bearing, to allow the inner bearing to freely move up and down in the waist-shaped hole; and a distance between the centers of circle at two ends of the waist-shaped hole is 3 mm.

Since the rotating shaft of the blade wheel employed by the present application is assembled in the waist-shaped hole of the supporting frame, the rotating shaft is movable up and down in the waist-shaped hole, therefore the whole blade wheel assembly may be pushed up by the banknotes to float upward during the banknote stacking process, meanwhile due to the tension springs, the blade wheel assembly may reset when not being pushed by the banknotes, therefore a flexible floating of the blade wheel assembly is realized. And under the cooperation control of the sensor, when the blade wheel assembly is pushed up by a certain degree (that is, an edge of the coded disc completely blocks the light-transmittable point of the sensor to make the sensor in a blocked state), the controllable support plate moves downward according to a signal of the sensor being blocked, thereby continuously increasing the banknote stacking space. The distance of the support plate moving downward each time may be controlled, therefore the banknotes can be stacked in order and compactly.

DETAILED DESCRIPTION

For further illustrating the banknote receiving device according to the present application, the banknote receiving device is further described in conjunction with figures of preferred embodiments of the present application hereinafter.

Figure 1:
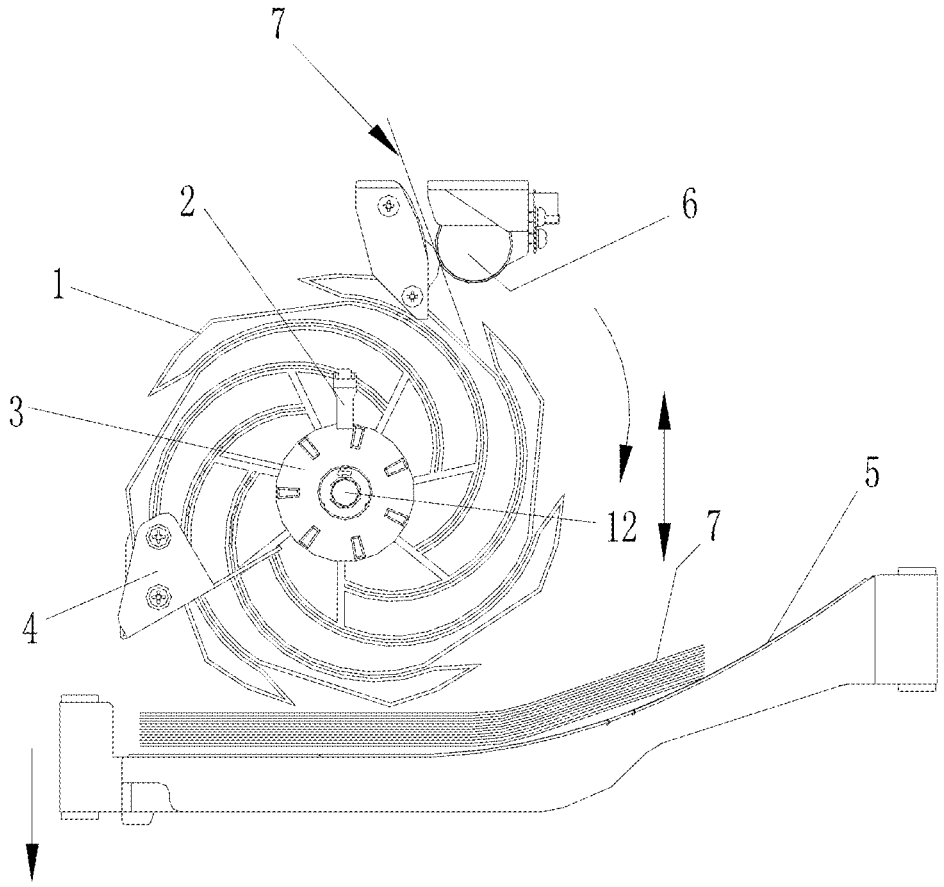
FIG. 1 is a schematic view showing a lateral structure of a banknote receiving device according to a preferred embodiment of the present application.
Figure 2:
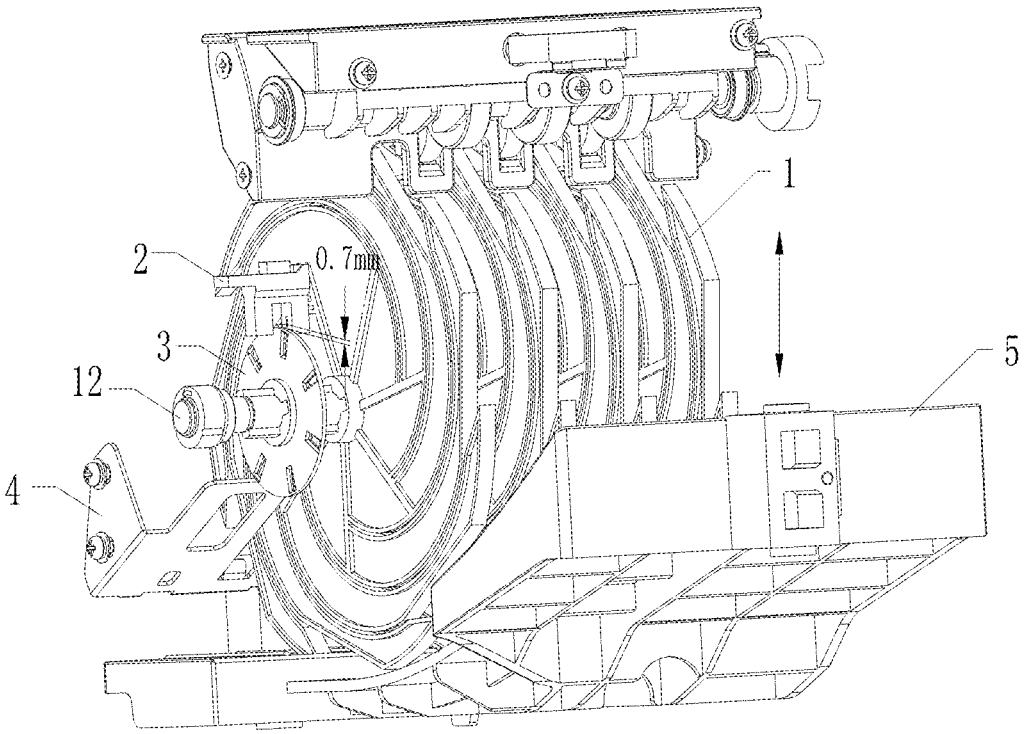
FIG. 2 is a perspective schematic view showing the structure of the banknote receiving device in FIG. 1.
Figure 5:
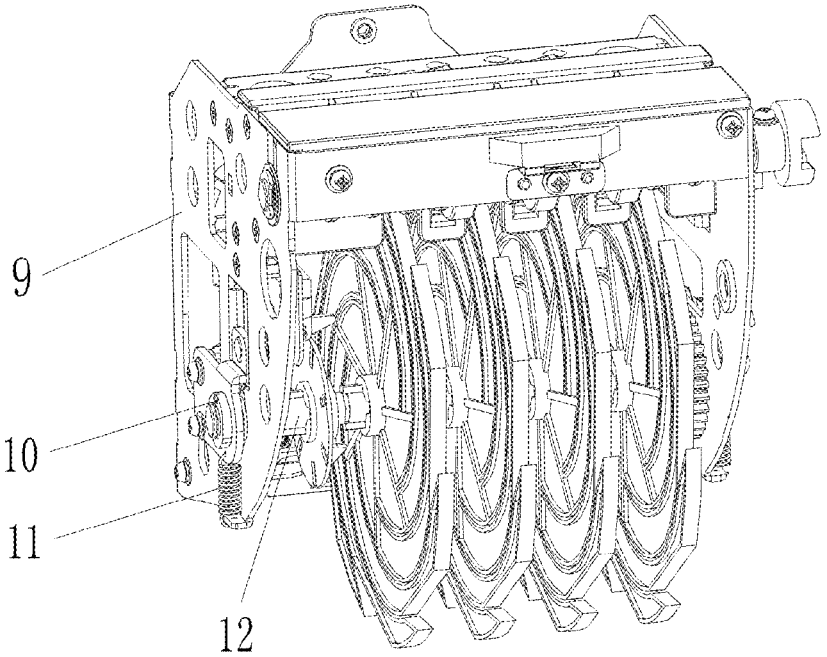
FIG. 5 is a perspective schematic view showing the structure of the banknote receiving device in FIG. 1, and showing a supporting frame used for mounting the components such as the blade wheel and etc., and showing the assembly relationship between a rotating shaft of the blade wheel and the supporting frame and the assembly position of a tension spring.

Reference is made to FIG. 1, FIG. 2 and FIG. 5. The banknote receiving device includes a supporting frame 9 configured to mount subsequent components; a pair of roller wheels 6 located at an inlet of the banknote receiving device and configured to bring in banknotes 7 by clamping; a blade wheel 1 mounted on the supporting frame 9 via a rotating shaft 12, joined with the pair of roller wheels 6 and configured to convey the banknotes 7 delivered from the pair of roller wheels 6 in a way of carrying the banknotes 7 and rotating at a high speed; a support plate 5 located below the blade wheel 1 and configured to carry the banknotes 7 delivered from the blade wheel 1. The support plate 5 is movable up and down under the action of a transmission mechanism, to adjust the size of a banknote receiving space. The banknote receiving device further includes a blade wheel floating control device configured to control the upward and downward floating of the blade wheel 1 and to further control the support plate 5 to move downward according to the upward floating degree of the blade wheel 1, to increase the banknote receiving space. Of course, the banknote receiving device further includes a banknote blocking plate 4, and a blocking strip of the banknote blocking plate 4 is inserted into blade clearances of the blade wheel 1. The blade wheel 1 constantly rotates, and when a front end of the banknote 7 hits the blocking strip of the blocking plate 4, the banknote 7 falls and is stacked up on the support plate 5.

Preferably, the supporting frame 9 includes two lateral plates which have the same structure, a waist-shaped hole 91 is provided in each lateral plate, and two ends of the rotating shaft 12 are respectively mounted in the waist-shaped holes 91 of the two lateral plates via a respective bearing 10. In this embodiment, the waist-shaped hole 91 is a shaped hole defining by two overlapping circles, the diameter of each of the two overlapping circles is 12 mm, a distance between centers of the two overlapping circles is 3 mm, that is, the upward and downward movement distance of the rotating shaft 12 in the waist-shaped hole 91 of the supporting frame 9 is 3 mm, and of course, the upward and downward movement distance may be adjusted according to design requirements by those skilled in the art.

Specifically, the blade wheel floating control device includes a coded disc 3, which is fixed on the rotating shaft 12, and can rotate synchronously with the blade wheel 1 and float up and down with the blade wheel 1; a sensor 2 fixed above the coded disc 3; and a pair of tension springs 11 arranged symmetrically. When floating up and down with the blade wheel 1, the coded disc 3 optionally blocks the light-transmittable point of the sensor 2, to allow the sensor 2 to sense the upward floating degree of the blade wheel 1. An upper end of each tension spring 11 is fixed on a small supporting piece of an outer bearing of the rotating shaft 12, and a lower end of each tension spring 11 is fixed on the lateral plate of the supporting frame 9. Besides, the banknote receiving device further includes a controller configured to receive a signal of the sensor 2 being blocked and control the support plate 5 to move downward by a predetermined distance. When the banknotes are stacked, the banknotes will push the blade wheel 1 upward, and the blade wheel 1 may float upward, that is because the rotating shaft 12 is allowed to move upward and downward since the rotating shaft of the blade wheel is mounted in the waist-shaped hole 91. When the blade wheel 1 moves upward, the coded disc arranged on the same shaft with the blade wheel also moves upward; and when the coded disc 3 completely blocks the light-transmittable point of the sensor 2 to make the sensor 2 in a blocked state, the sensor 2 senses that the blade wheel has been pushed up by a certain degree, the controller controls the support plate 5 to move downward by a predetermined distance, and at this time the banknotes 7 moves downward with the support plate 5. Without the pushing of the banknotes 7, the blade wheel 1 returns to a original position under the action of the tension springs 11, thereby realizing the control of the upward and downward floating of the blade wheel 1 and the downward movement of the support plate 5.

Preferably, the bearings include an inner bearing 14 and an outer bearing 10. The inner bearing 14 is sleeved on the rotating shaft 12 and arranged inside the waist-shaped hole 91 of the supporting frame 9. The outer bearing 10 is sleeved on the inner bearing 14 and assembled on the rotating shaft 12, and is fixed to the respective small supporting pieces 15, 16. The outer bearing 10 is not assembled in the waist-shaped hole 91 of the supporting frame 9.

The operation process and principle of the banknote receiving device are described in detail hereinafter. Referring to FIG. 1, the banknotes 7 enter into the clearances of the blade wheel 1 along the roller wheels 6, the blade wheel 1 rotates clockwise to draw in the banknotes 7, and then the banknotes 7 are stacked up on the support plate 5 under the action of the banknote blocking plate 4. During this process, the blade wheel 1 rotates clockwise to draw in the banknotes 7, and when the banknotes stacked on the support plate 5 have a certain thickness and come into contact with the blade wheel 1, the banknotes continuously being drawn in by the blade wheel 1 and stacked on the support plate 5 slowly raise the blade wheel 1, and with the rising of the stacked banknotes, the blade wheel 1 which may float flexibly also slowly rises. When an edge of the coded disc 3 blocks the sensor 2, the support plate 5 is controlled by the controller program to move downward by a certain distance. The above process is repeated, that is, the blade wheel 1 continues to rotate to draw in the banknotes 7 to stack the banknotes 7 on the support plate 5, the banknotes 7 stacked on the support plate 5 continue to rise to raise the blade wheel 1, and the support plate moves downward by a predetermined distance when the coded disc 3 fixed at the same shaft with the blade wheel 1 blocks the sensor 2. With the above process being continuously repeated, an infinite number of banknotes may be stacked (if there is enough space). Since the time of the support plate 5 starting to move downward is depending on the state of the sensor 2, the downward movement degree can be easily controlled, and can be implemented simply. This structure is especially applicable for the banknote receiving device.

Figure 6:
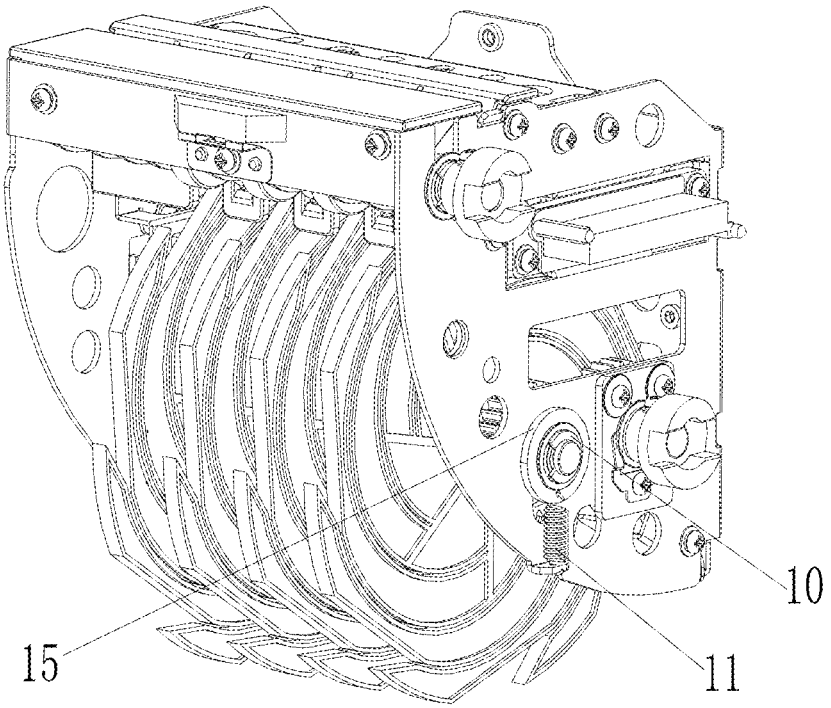
FIG. 6 is a perspective schematic view showing another side of the banknote receiving device in FIG. 5, and mainly showing a pair of tension springs symmetrically located at two sides of the supporting frame respectively.
Figure 7:
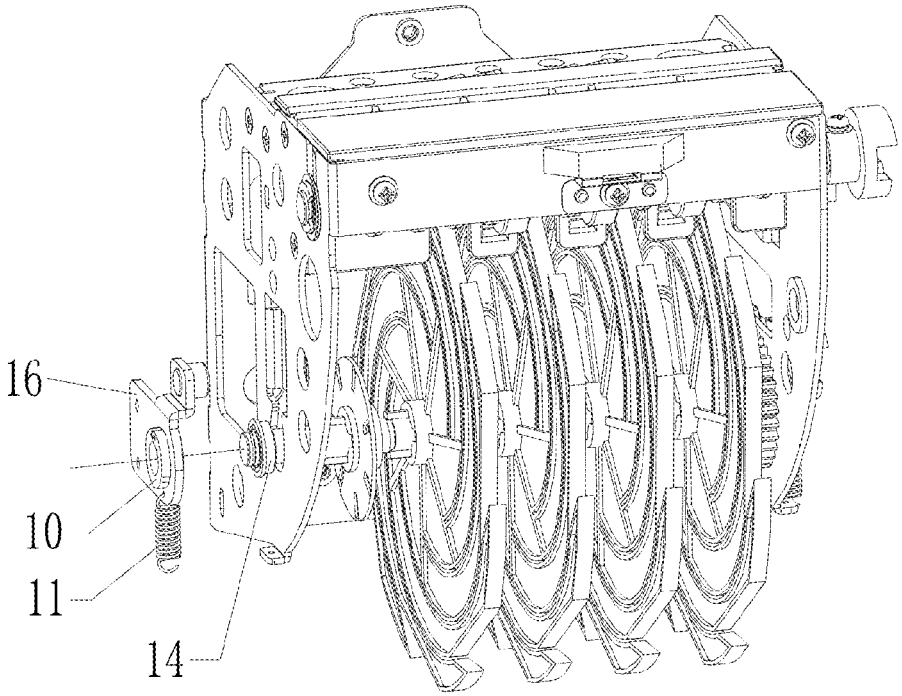
FIG. 7 is a partial exploded view of the perspective schematic view of the banknote receiving device in FIG. 5, and mainly showing the position relationship between the bearing and the tension spring.
Figure 8:
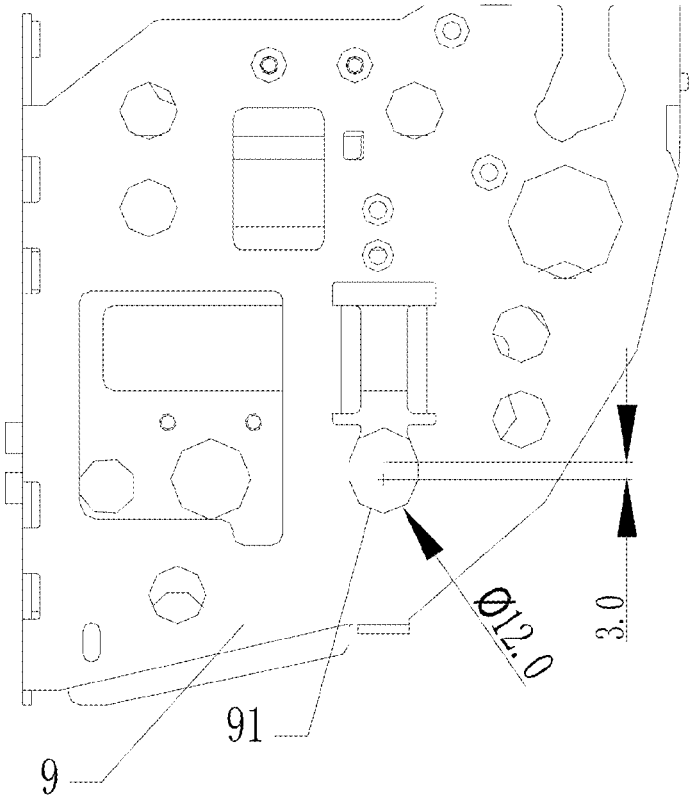
FIG. 8 is a schematic view showing a plane structure of a lateral plate of the supporting frame, and mainly showing a waist-shaped hole provided at the lateral plate and the relevant size of the waist-shaped hole.

The principle of the upward and downward floating of the blade wheel is introduced hereinafter. Referring to FIG. 5 to FIG. 8, a blade wheel floating tension spring 11 is assembled at both the left side and right side of the supporting frame 9. One end of each tension spring 11 is fixed at a lower end of the supporting frame 9, and another end of the tension spring 11 is fixed in a small hole of the respective small supporting pieces 15, 16 which are fixed to the bearings 10. The bearings 10, the rotating shaft 12 of the blade wheel, the blade wheel 1 and the code disc 3 are movable up and down in the waist-shaped hole 91 of the supporting frame 9. The inner bearing 14 (one inner bearing 14 being arranged at both the right side and left side of the supporting frame) is assembled inside the bearing 10, and the inner bearing 14 and the bearing 10 are both assembled on the rotating shaft 12 of the blade wheel and are movable up and down in the waist-shaped hole 91 of the supporting frame 9. As shown in FIG. 6, a distance of the upward and downward movement in the waist-shaped hole 91 of the supporting frame 9 is 3 mm, a diameter of the hole is 12 mm (the diameter of the hole only needs to be slightly greater than an outer diameter of the inner bearing, which is convenient for the inner bearing to move up and down in the waist-shaped hole, and the diameter of the hole may be adjusted according to the design requirement). The inner bearing 14 is sleeved on the rotating shaft 12 of the blade wheel and arranged in the waist-shaped hole 91 of the supporting frame 9. The bearing 10 is sleeved on the inner bearing 14, and is just assembled on the rotating shaft 12 of the blade wheel and is not assembled in the waist-shaped hole 91 of the supporting frame 9, which may refer to FIG. 7. In the case of money depositing operation, the assembly of the blade wheel and the coded disc rotates in the bearing 14 and the bearing 10, the banknotes 7 are continuously stacked to push the blade wheel 1 upward slowly, which makes the tension spring 11 in a more tensed state. When the blade wheel rises to a certain degree, the coded disc 3 blocks the sensor 2, the controller controls the support plate 5 to move downward to increase the banknote stacking space, and at this time, without the supporting of the banknotes, the blade wheel 1 recovers to the original position, thereby realizing the upward and downward movement.

Some key points for realizing the above process is described in detail hereinafter.

Figure 3:
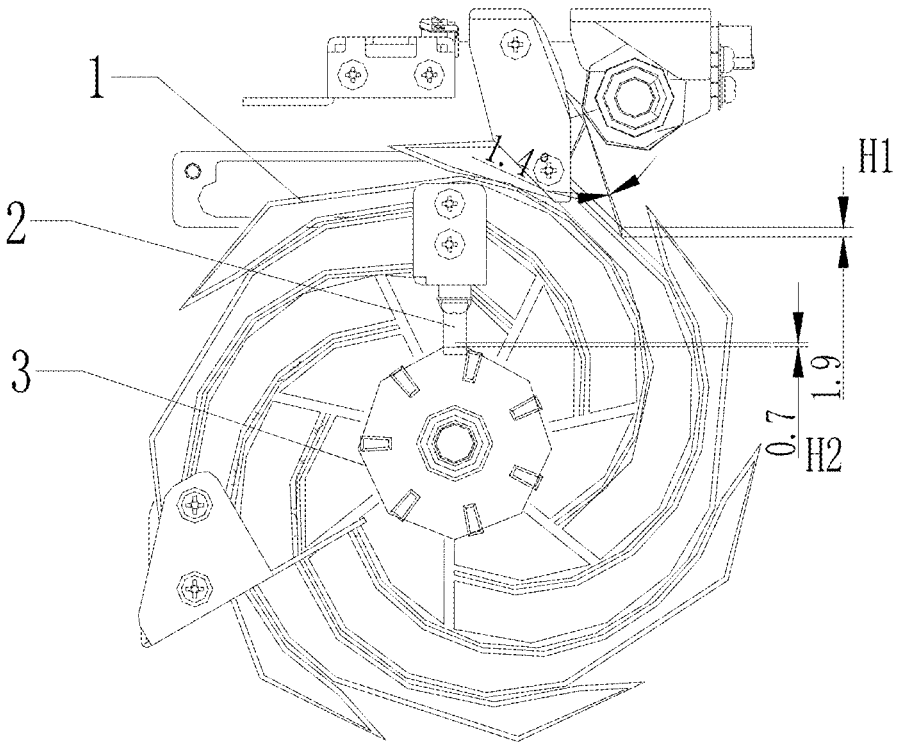
FIG. 3 is a schematic view showing a lateral structure of part of the components of the banknote receiving device in FIG. 1, and mainly showing a relative position relationship between a coded disc and a sensor, and a floating range of a blade wheel.

Referring to FIG. 3, an initial position of the coded disc 3 is at a position 0.7 mm lower than the light-transmittable line of the sensor 2, and in this state, the sensor 2 is in a conductive state; When banknotes stacked on the support plate 5 raises the floating blade wheel 1 to make the edge of the coded disc 3 block the sensor 2, that is the sensor 2 is in a blocked state, the support plate 5 may move downward by a certain distance, and then the above process is repeated. A distance of the coded disc 3 rising to block the sensor 2 is approximately 1.9 mm. Thus a problem may occur, an edge point where the banknote is inserted into the blade wheel 1 fluctuates in a range of 1.9 mm, and through theoretical analysis and mass practical tests, the fluctuating range has almost no effect on the blade wheel 1 drawing in banknotes. Referring to FIG. 3, at the inlet of the blade wheel 1, a floating range of the blade wheel 1 is 1.9 mm, a variation of the angle of the banknotes being inserted at the inlet is 1.4 degrees, and the slight angle variation has almost no effect on the blade wheel 1 drawing in banknotes.

Figure 4:
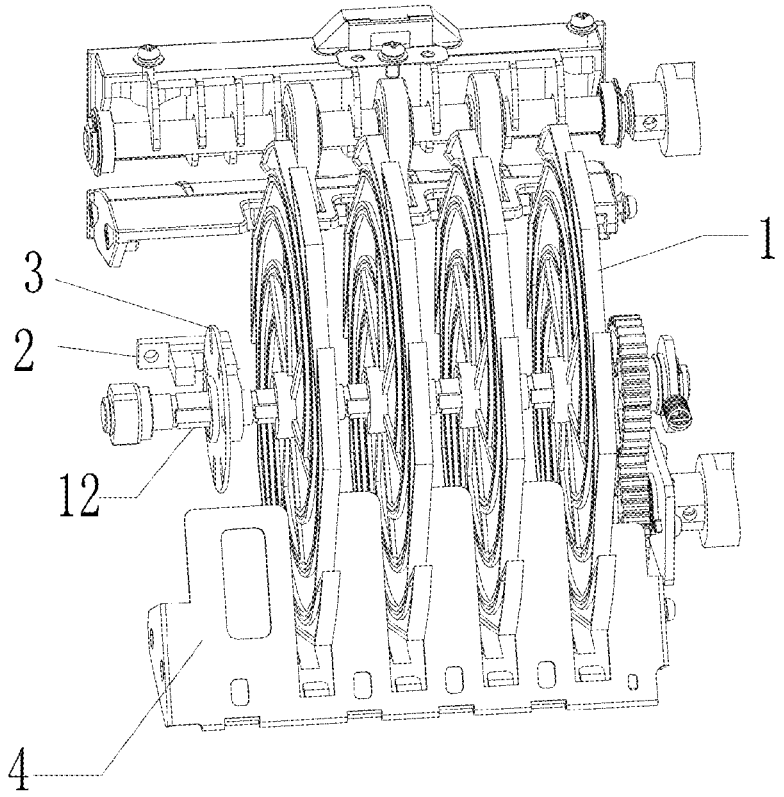
FIG. 4 is a perspective schematic view showing the front structure of the banknote receiving device in FIG. 1, wherein a support plate is not shown, and the position relationship among the blade wheel, the coded disc and the rotating shaft is mainly shown.

Referring to FIG. 4, the blocking strip of the banknote blocking plate 4 is inserted into the blade clearances of the blade wheel 1, the blade wheel 1 continuously rotates, and when the front ends of the banknotes 7 hit the blocking strip of the banknote blocking plate 4, the banknotes 7 fall and are stacked up on the support plate 5. In the falling process, under the action of the friction from a convex edge of the rotating blade wheel 1, the banknotes 7 continue to move forward and are stopped when arriving at the blocking lateral plate. With the above process being continuously repeated, the head portions of the banknotes are aligned at the blocking lateral side, thus realizing an orderly stacking of the banknotes.

A whole set of blade wheel floating control device is mainly composed of a flexibly floating blade wheel, a sensor 2 for detecting the state of the blade wheel, a coded disc 3, a banknote blocking plate 4 for blocking the banknotes, a support plate 5 which may be controlled to move, other basic components, and some transmission mechanisms which are used for moving the support plate. Since the rotating shaft 12 of the blade wheel 1 employed by the present embodiment is assembled in the waist-shaped hole 91 of the supporting frame 9, the rotating shaft 12 is movable up and down in the waist-shaped hole 91, therefore the whole blade wheel assembly may be pushed up by the banknotes to float upward during the banknote stacking process, meanwhile due to the tension springs 11, the blade wheel assembly may reset when not being pushed by the banknotes, therefore a flexible floating of the blade wheel assembly is realized. And under the cooperation control of the sensor 2, when the blade wheel is pushed up by a certain degree, the coded disc 3 assembled at the same shaft with the blade wheel 1 is also pushed up by a certain degree to move upward to a position blocking the sensor 2, and at this moment, the support plate 5 is controlled by the program to move downward, thereby continuously increasing the banknote stacking space. The distance of the support plate 5 moving downward each time may be controlled, therefore the banknotes can be stacked in order and compactly.

The embodiments described hereinabove are only preferred embodiments of the present application, it should be noted that, the above preferred embodiments should not be interpreted as limitation to the present application, and the scope of the present application should be defined by the claims. For the person skilled in the art, a few of improvements and modifications may be made to the present application without departing from the spirit and scope of the present application, and these improvements and modifications are also deemed to fall into the scope of the present application.

The invention claimed is:

1. A banknote receiving device, comprising:

a supporting frame, configured to mount subsequent components;

a pair of roller wheels, located at an inlet of the banknote receiving device and configured to bring in banknotes by clamping;

a blade wheel, mounted on the supporting frame via a rotating shaft, the blade wheel being joined with the pair of roller wheels and configured to convey the banknotes delivered from the pair of roller wheels in a way of carrying the banknotes and rotating at a high speed; and a support plate, located below the blade wheel, configured to carry the banknotes delivered from the blade wheel, the support plate being movable up and down under the action of a transmission mechanism to adjust a size of a banknote receiving space;

wherein the banknote receiving device further comprises a blade wheel floating control device configured to control an upward and downward floating of the blade wheel and to further control the support plate to move downward according to an upward floating degree of the blade wheel to increase the banknote receiving space; and the supporting frame comprises two lateral plates having the same structure, each of the lateral plates is provided with a shaped hole, and two ends of the rotating shaft are respectively mounted in the shaped holes of the two lateral plates via respective bearings; and wherein, the blade wheel floating control device comprises:

a coded disc, which is fixed on the rotating shaft, is rotatable synchronously with the blade wheel and floatable up and down with the blade wheel;

a sensor, fixed above the coded disc, wherein the coded disc is configured to optionally block a light-transmittable point of the sensor when the coded disc floats up and down with the blade wheel, to allow the sensor to sense the upward floating degree of the blade wheel; and a pair of tension springs arranged symmetrically, each of the tension springs having an upper end fixed on the respective bearing of the rotating shaft and a lower end fixed on the respective lateral plate of the supporting frame.

2. The banknote receiving device according to claim 1, wherein each of the bearings comprises an inner bearing and an outer bearing, the inner bearing is sleeved on the rotating shaft and arranged in the respective shaped hole of the supporting frame, the outer bearing is sleeved on the inner bearing and assembled on the rotating shaft, and is not assembled in the shaped hole of the supporting frame, and the outer bearing is fixed to a small supporting piece, and the small supporting piece is provided with a small hole for hanging the tension spring.

3. The banknote receiving device according to claim 2, wherein the shaped hole is defined by two overlapping circles, a distance between centers of the two overlapping circles is 3 mm, and a diameter of each of the two overlapping circles hole is slightly greater than an outer diameter of the inner bearing.

4. The banknote receiving device according to claim 1, wherein an initial position of the coded disc is located at a position 0.7 mm below the light-transmittable point of the sensor.

5. The banknote receiving device according to claim 1, wherein the banknote receiving device further comprises a controller configured to receive a signal of the sensor being blocked and control the support plate to move downward by a predetermined distance.

6. A blade wheel floating control device, comprising:

a supporting frame, having two lateral plates having the same structure, each of the lateral plates being provided with a shaped hole;

a rotating shaft, two ends of which are respectively mounted in the shaped holes of the two lateral plates of the supporting frame, wherein the rotating shaft is floatable up and down in the shaped holes, and a blade wheel is mounted on the rotating shaft and is rotatable around the rotating shaft at a high speed;

a coded disc, which is fixed on the rotating shaft, is rotatable synchronously with the blade wheel and floatable up and down with the rotating shaft;

a sensor, fixed above the coded disc, wherein the coded disc is configured to optionally block a light-transmittable point of the sensor when the coded disc floats up and down with the rotating shaft, to allow the sensor to sense an upward floating degree of the blade wheel; and a pair of tension springs arranged symmetrically, each of the tension springs having an upper end fixed on a small supporting piece of a respective outer bearing of the rotating shaft and a lower end fixed on the respective lateral plate of the supporting frame.

7. The blade wheel floating control device according to claim 6, wherein an initial position of the coded disc is located at a position 0.7 mm below the light-transmittable point of the sensor.

8. The blade wheel floating control device according to claim 6, wherein, two ends of the rotating shaft are respectively mounted in the shaped holes of the two lateral plates via respective inner bearings.

9. The blade wheel floating control device according to claim 8, wherein the shaped hole is defined by two overlapping circles, a distance between centers of the two overlapping circles is 3 mm, and a diameter of each of the two overlapping circles is slightly greater than an outer diameter of the respective inner bearing.

* * * * *